US006761601B2

(12) United States Patent
Nakajima et al.

(10) Patent No.: US 6,761,601 B2
(45) Date of Patent: Jul. 13, 2004

(54) PERSONAL WATERCRAFT

(75) Inventors: Jun Nakajima, Saitama (JP); Yoshiaki Noda, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/282,100

(22) Filed: Oct. 29, 2002

(65) Prior Publication Data

US 2003/0129888 A1 Jul. 10, 2003

(30) Foreign Application Priority Data

Oct. 31, 2001 (JP) ..... 2001-335028

(51) Int. Cl.[7] ..... B63H 2/10
(52) U.S. Cl. ..... 440/88 A; 114/55.5
(58) Field of Search ..... 440/88 A; 114/55.5, 114/55.51, 55.57

(56) References Cited

U.S. PATENT DOCUMENTS 3,623,447 A * 11/1971 Jacobson ..... 114/55.51
5,181,870 A * 1/1993 Arai et al. ..... 440/77
5,735,229 A * 4/1998 House et al. ..... 114/363
5,957,072 A * 9/1999 Hattori ..... 114/55.57

OTHER PUBLICATIONS

Patent Abstracts of Japan, No. 08048287 A, published Feb. 2, 1996 Title: Compact Planning a Boat.

* cited by examiner

*Primary Examiner*—Stephen Avila
(74) *Attorney, Agent, or Firm*—Birch, Stewart, Kolasch & Birch, LLP

(57) ABSTRACT

To provide a personal watercraft such that sea water or water can be prevented from being accumulated in an intake system equipment, and sea water or water can be prevented from penetrating into an engine even if the sea water or water should have penetrated into a watercraft body. A personal watercraft has a structure in which a watercraft body includes a hull constituting a lower portion of the watercraft body and a deck constituting an upper portion of the watercraft body. An engine is mounted in a space surrounded by the watercraft body. An intake system of the engine is provided with a vertically elongate air box. A lower portion of the air box is provided with first and second air suction ports. An inlet of an air passage for leading air from the air box to the engine is opened in the upper half of the air box.

19 Claims, 7 Drawing Sheets

PERSONAL WATERCRAFT

CROSS-REFERENCE TO RELATED APPLICATIONS

This nonprovisional application claims priority under 35 U.S.C. §119(a) on Patent Application No. 2001-335028 filed in JAPAN on Oct. 31, 2001, which is herein incorporated by reference.

BACKGROUND OF THE INVENTION

1. Field of the Invention

The present invention relates to a personal watercraft in which a deck is assembled onto a hull to constitute a watercraft body. An engine is mounted in a space surrounded by the watercraft body. Furthermore, an intake system of the engine is provided with a vertically elongated air box.

2. Description of Background Art

A personal watercraft is known from, for example, Japanese Patent Laid-Open No. Hei 8-48287 entitled "PERSONAL PLANING WATERCRAFT." FIG. 1 of the above publication has been reproduced as FIG. 7 of the present invention. It should be noted that the reference numerals have been re-assigned in FIG. 7 to avoid confusion with FIGS. 1–6 of the present invention.

Referring to FIG. 7, a sectional view of the personal watercraft of the above publication is illustrated. The personal watercraft 100 has a structure in which left and right side walls 102 and 103 are provided at substantially central portions of a deck 101. A saddle ride type seat 104 is provided at the upper ends of the left and right side walls 102 and 103. An engine 105 is disposed on the lower side of the seat 104, directed in the front-rear direction of a watercraft body 106. In addition, intake system equipment 108 is provided in a space on the left side of the engine 105.

The intake system equipment 108 has a structure in which an intake silencer 108*b* is in communication with cylinders 105*a* of the engine 105 through air funnels 108*a*. An intake pipe 108*c* is in communication with the intake silencer 108*b*. According to the intake system equipment 108, air sucked into the intake pipe 108*c* through a suction port 108*d* of the intake pipe 108*c* can be led into the intake silencer 108*b*. The air led into the intake silencer 108*b* can be introduced into the cylinders 105*a* through the air funnels 108*a*.

However, the intake pipe 108*c* is horizontally extended rearwards from a rear wall of the intake silencer 108*b* and towards the center 106*a* of the watercraft body 106. The lower end 108*e* of a connection portion for connecting the intake pipe 108*c* to the rear wall of the intake silencer 108*b* is located above a bottom surface 108*f* of the intake silencer 108*b*. With this structure, if sea water or water should penetrate into the intake silencer 108*b*, the sea water or water would accumulate in the intake system equipment 108, particularly in the intake silencer 108*b*.

In addition, sea water or water may penetrate into the watercraft body during operation of the personal watercraft. If sea water or water penetrates into the watercraft body, the sea water or water may penetrate into the cylinders 105*a* through the air funnels 108*a*. Therefore, it has been desired to put into practical use a personal watercraft 100 in which the penetration of sea water or water into the cylinders 105*a* can be prevented even if the sea water or water penetrates into the watercraft body 106.

SUMMARY OF THE INVENTION

Accordingly, it is an object of the present invention to provide a personal watercraft in which sea water or water can be prevented from accumulating in intake system equipment and in which penetration of sea water or water into an engine can be prevented even if the sea water or water penetrates into the watercraft body.

In order to solve the above problems, a first aspect of the present invention is directed to a personal watercraft, which includes a watercraft body comprised of a combination of a hull constituting a lower portion of the watercraft body and a deck constituting an upper portion of the watercraft body. An engine is mounted in a space surrounded by the watercraft body. An intake system of the engine is provided with a vertically elongate air box. An air suction port for sucking in air is provided at a lower portion of the air box. Furthermore, the inlet of an air passage for leading air from the air box to the engine is opened in the upper half of the air box.

The intake system of the engine is provided with the air box, and the air suction port for sucking in air is provided at the lower portion of the air box. With this structure, even if the personal watercraft is turned upside down and sea water or water penetrates into the air box, the sea water or water in the air box can be drained through the air suction port by restoring the personal watercraft to the normal posture.

In addition, with the inlet of the air passage for leading air to the engine opened in the upper half of the air box, the inlet of the air passage can be located at a high position. With this structure, even if sea water or water penetrates into the watercraft body, the sea water or water can be restrained from rising up to the inlet of the air passage.

A second aspect of the present invention includes an air filter provided between the air suction port and the inlet of the air passage. The interior of the air box is partitioned by the air filter into upper and lower portions.

With the air filter provided between the air suction port and the inlet of the air passage, air sucked in through the air suction port can be led to the inlet of the air passage through the air filter. Accordingly, dust and the like contained in the air can be removed by the air filter, so that clean air can be led to the inlet of the air passage.

A third aspect of the present invention includes a cut-off wall provided on and surrounding a top plate of the air box. The cut-off wall is provided with a cutout portion for draining water at a portion away from the air suction port.

With the cut-off wall provided along and surrounding the outer periphery of the top plate constituting the air box, a recessed portion can be formed by the outer periphery of the top plate and the cut-off wall. Therefore, sea water or water splashed onto the top plate can be led to the recessed portion. Furthermore, with the cut-off wall provided with the cutout portion, the cutout portion can be in communication with the recessed portion. Accordingly, the sea water or water led to the recessed portion can be drained through the cutout portion.

In addition, with the cutout portion formed at a portion away from the air suction port, the sea water or water drained through the cutout portion can be prevented from splashing onto the air suction port.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
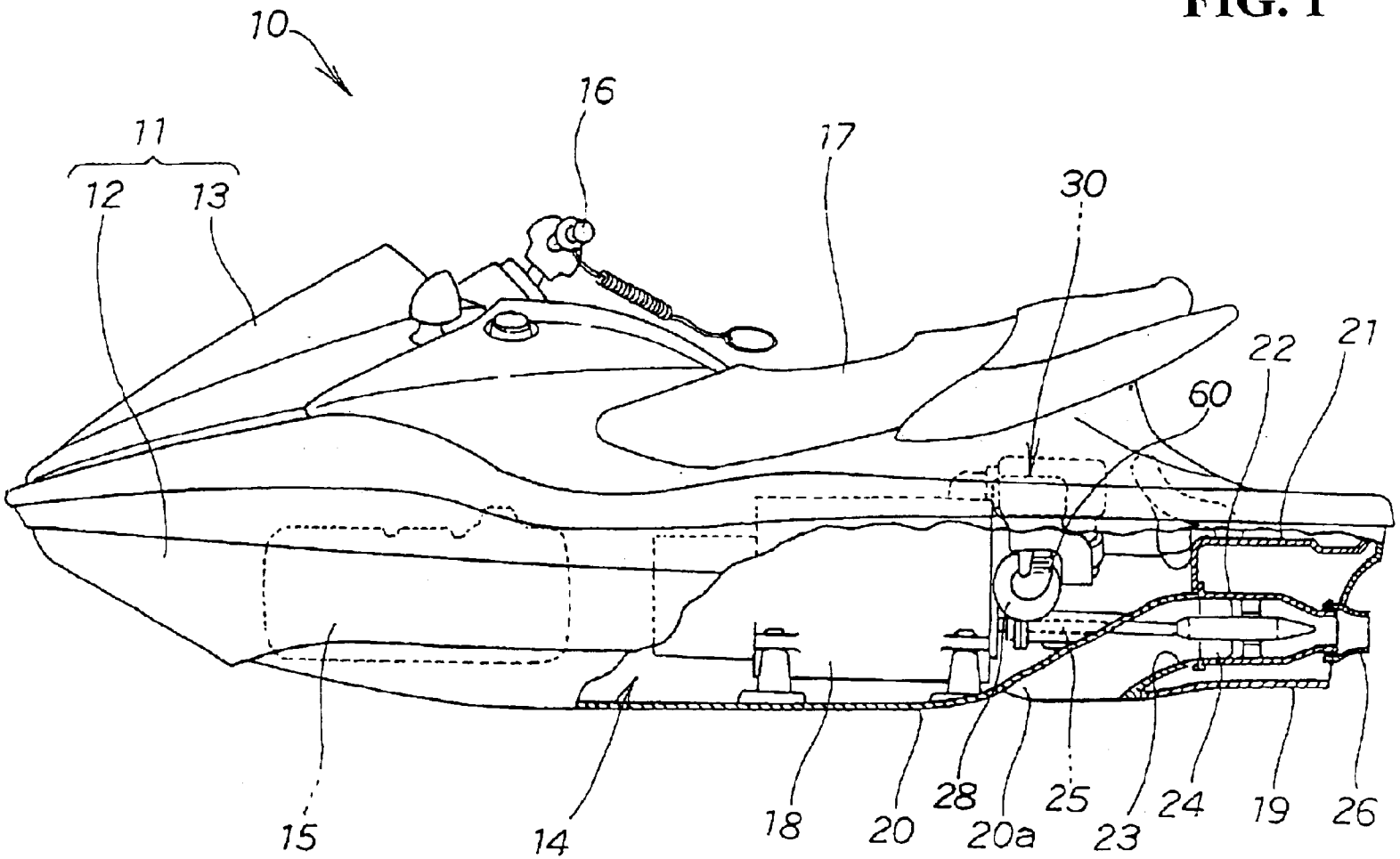
FIG. 1 is a side view of a personal watercraft according to the present invention.

The present invention will now be described with reference to the accompanying drawings. The drawings should be viewed in the direction of the orientation of the reference numerals.

FIG. 1 is a side view of a personal watercraft according to the present invention. The personal watercraft 10 is a jet propulsion watercraft in which a watercraft body 11 includes a combination of a hull 12 constituting a lower portion of the watercraft body 11 and a deck 13 constituting an upper portion of the watercraft body 11. A fuel tank 15 is disposed at a front portion of a space 14 surrounded by the watercraft body 11. A steering handle 16 is provided on the upper side of the fuel tank 15. A saddle ride type seat 17 is provided on the rear side of the steering handle 16. An engine 18 is disposed in a space 14 on the lower side of the seat 17. An intake system provided at a side surface of the engine 18 is provided with a vertically elongate air box 30. A jet propeller chamber 21 is provided at a stem 19 on the rear side of the engine 18. Furthermore, a jet propeller 22 is provided in the jet propeller chamber 21.

The jet propeller 22 includes a housing 23 extending rearwards from an inlet 20*a* of a watercraft bottom 20. An impeller 24 is rotatably fitted in the housing 23. The impeller 24 is connected to a drive shaft 25 of the engine 18.

At the time of propelling the personal watercraft 10, air in the space 14 is sucked into the air box 30. The air sucked into the air box 30 is led through an air passage 60 to a turbocharger 28. Fuel from the fuel tank 15 is mixed with the air which has passed through the turbocharger 28. The resulting mixture gas is introduced into a cylinder or cylinders (not shown) of the engine 18.

The engine 18 is driven by the mixture gas, whereby the impeller 24 is rotated by the engine 18. Accordingly, water is sucked in through the inlet 20*a* at the watercraft bottom 20, and the water thus sucked in is led through the housing 23 to a steering nozzle 26 as jet water. The jet water led to the steering nozzle 26 is jetted through the steering nozzle 26, whereby the personal watercraft 10 can be propelled.

Figure 2:
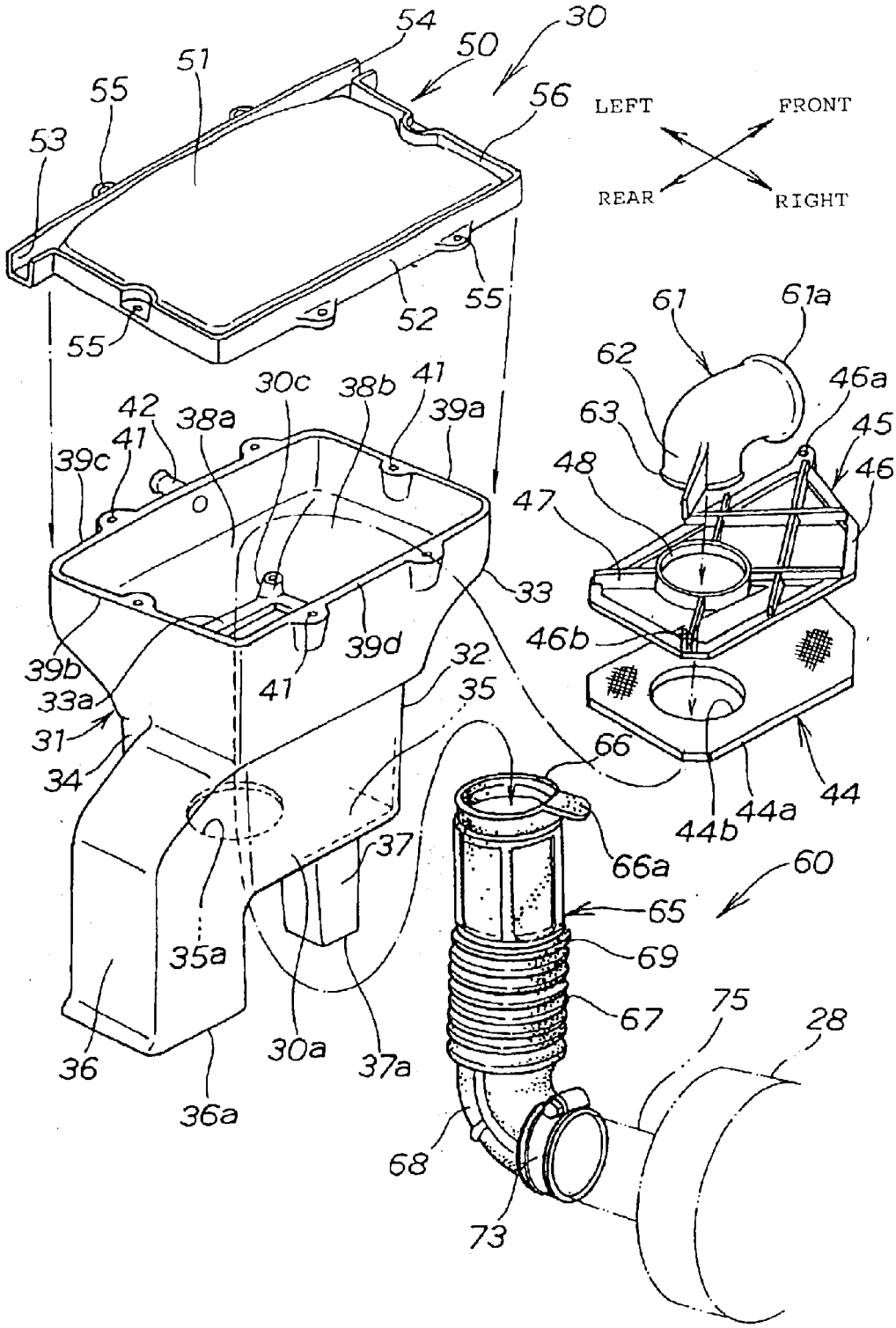
FIG. 2 is an exploded perspective view showing an air box provided in the personal watercraft according to the present invention.

FIG. 2 is an exploded perspective view showing the air box provided in the personal watercraft according to the present invention. The air box 30 includes a box main body 31 which fixes the air passage 60 and is provided with first and second air suction ports 36*a* and 37*a* at a lower portion 30*a* thereof. An air filter 44 is disposed in the box main body 31 to partition the box main body 31 into upper and lower portions. A presser member 45 is provided for preventing the air filter 44 from floating up. Furthermore, a cover body 50 is detachably bolted to the upper end 30*b* of the box main body 31. The box main body 31 is a resin or resin-like member in which the lower half 32 is formed in a rectangular shape, and the upper half 33 is formed integrally with the upper end of the lower half 32.

In particular, the box main body 31 has a structure in which a rear wall 34 of the lower half 32 is provided with a first air suction tube 36. A floor portion 35 of the lower half 32 is provided with a second air suction tube 37 and with a locking hole 35*a* for locking and fitting an annular groove 69 of the air passage 60. The upper half 33 is provided at its lower end portion with a stepped portion 33*a* for mounting the air filter 44 thereon. A left side wall 38*a* and a right side wall 38*b* of the upper half 33 are formed with a rising gradient so that the opening area is gradually increased from a lower end portion toward an upper end portion of the upper half 33. The upper end portion of the upper half 33 is formed as a substantially rectangular opening by providing front, rear, left and right sides 39*a*–39*d*. Furthermore, the front, rear, left and right sides 39*a*–39*d* are provided with screw holes 41.

The first and second air suction tubes 36 and 37 are in communication with the interior of the box main body 31, whereby air can be sucked into the lower half 32 of the box main body 31 through a suction port (first suction port) 36*a* of the first air suction tube 36 and a suction port (second suction port) 37*a* of the second air suction tube 37. With regard to the suction of air into the interior of the box main body 31, the suction through the first air suction tube 36 is principal, and the suction through the second air suction tube 37 is subsidiary. Therefore, the flow passage area of the first air suction tube 36 is ensured to be larger than the flow passage area of the second air suction tube 37. The primary reason for providing the second air suction tube 37 will later be described in detail referring to FIG. 5.

In addition, the left side wall 38*a* of the upper half 33 is provided with a breather pipe 42, and a breather hose extending from a cylinder head cover or the like of the engine is connected to the breather pipe 42. The air filter 44 has an outer periphery 44*a* formed in a substantially rectangular shape conforming to the stepped portion 33*a* of the box main body 31 so that it can be mounted on the stepped portion 33*a*, and is provided in the vicinity of its rear end with a through-hole 44*b* into which the air passage 60 can be inserted. By passing air through the air filter 44, dust and the like contained in the air can be removed.

The presser member 45 is a member in which a frame body 46 is formed in a substantially rectangular shape conforming to the outer shape of the air filter 44. The frame body 46 is provided with a fitting hole 46*a*. The frame body 46 is integrally formed with ribs 47 for reinforcement. Furthermore, a ring 48 is held by the ribs 47.

A bolt 49 (shown in FIG. 3) is inserted into the fitting hole 46*a*. The bolt 49 thus inserted is screw-connected to a boss 30*c* of the box main body 31, whereby the filter 44 is prevented by the presser member 45 from floating up.

The ring 48 is a member which is so formed that the air passage 60 can be inserted therein, which has the same diameter as the through-hole 44*b* of the air filter 44, and which is disposed coaxially with the through-hole 44*b*.

The cover body 50 is a member formed in a substantially rectangular shape conforming to the upper end opening of the box main body 31. A cut-off wall 52 is provided along and surrounding the outer periphery of a rectangular top plate 51. The cut-off wall 52 is provided with first and second trough portions (cutout portions) 53 and 54 for draining at portions away from the first air suction tube 36 and the second air suction tube 37. Furthermore, bolt fitting holes 55 are provided on the outside of the cut-off wall 52. With bolts (not shown) inserted into the bolt fitting holes 55 and with the inserted bolts screw-connected into the screw holes 41 of the box main body 31, the cover body 50 can be fitted to the box main body 31.

A recessed portion 56 (See also FIG. 3) is formed by the outer periphery of the top plate 51 and the cut-off wall 52. The recessed portion 56 is in communication with the first and second trough portions 53 and 54, whereby sea water or water splashing onto the top plate 51 is led to the recessed portion 56. Furthermore, the sea water or water led to the recessed portion 56 is led to the first and second trough portions 53 and 54 and drained through the first and second trough portions 53 and 54.

The air passage 60 includes a funnel 61 disposed in the upper half 33 of the box main body 31. A connection tube 65 is in communication with a lower end portion 62 of the funnel 61. The connection tube 65 is a rubber or rubber-like intake tube in which an upper end portion 66 is connected to the lower end portion 62 of the funnel 61. The connection tube 65 extends downwards from the upper half 33 of the box main body 31 to penetrate through the lower half 32. A bellows portion 67 projects out through the locking hole 35*a* formed in the floor portion 35 of the lower half 32. Furthermore, an elbow (lower end portion) 68 on the lower side of the bellows portion 67 is in communication with the turbocharger 28 through a pipe 75.

The connection tube 65 is provided with a projection piece 66*a* at the upper end portion 66 thereof. The projection piece 66*a* is raised substantially vertically by elastic deformation at the time of assembly, and in this condition, the upper end portion 66 of the connection tube 65 is inserted into the through-hole 44*b* of the air filter 44 and the ring 48 of the presser member 45. Accordingly, pressing against the ring 48 is effected by a restoring force of the projection piece 66*a* after assembly, and the air filter 44 can be prevented from floating up.

Figure 3:
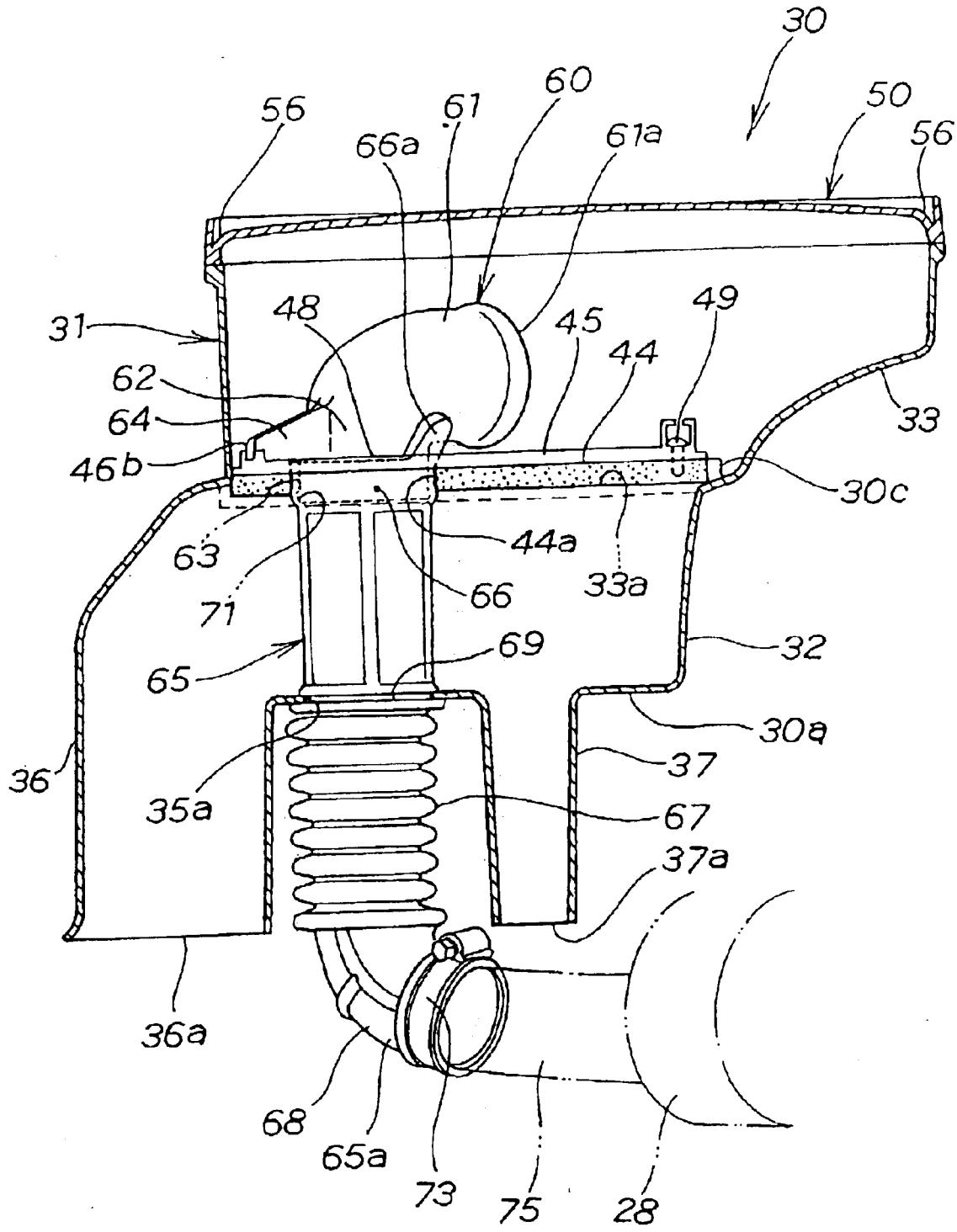
FIG. 3 is a sectional view showing the air box provided in the personal watercraft according to the present invention.

FIG. 3 is a sectional view showing the air box provided in the personal watercraft according to the present invention, and shows the condition where the air passage 60 is fitted to the air box 30. Concretely, the annular groove 69 at the center of the connection tube 65 is fitted to the locking hole 35*a* of the lower half 32 of the box main body 31. The through-hole 44*a* of the air filter 44 and the ring 48 (See also FIG. 2) of the presser member 45 are fitted to the upper end portion 66 of the connection tube 65 in the condition where the projection piece 66*a* of the connection tube 65 is elastically deformed upwards. The presser member 45 is pressed downwards by the restoring force of the projection piece 66*a*. Furthermore, the bolt 49 is screw-connected to the boss 30*c* of the stepped portion 33*a*, whereby the presser member 45 and the air filter 44 are prevented from floating up.

In this condition, a lower end portion 62 of the funnel 61 is fitted to the upper end portion 66 of the connection tube 65, whereby an annular bulged portion 63 of the lower end portion 62 of the funnel 61 is locked with an annular recessed portion 71 of the upper end portion 66 of the connection tube 65. A positioning projection piece 64 of the funnel 61 is disposed in a positioning recessed portion 46*b* of the presser member 45. A lower end portion 65*a* (namely, an outlet of the elbow 68) of the connection tube 65 is inserted into the pipe 75, and in this condition, a fastening ring is fastened. The connection tube 65 is connected to the turbocharger 28 through the pipe 75. Furthermore, the upper end opening of the box main body 31 is closed with the cover body 50.

Accordingly, the first and second air suction ports (air suction ports) 36*a* and 37*a* for sucking in air are provided at the lower portion 30*a* of the air box 30. Furthermore, the inlet of the air passage 60 for leading air from the air box 30 to the engine 18 (shown in FIG. 1) (namely, the inlet 61*a* of the funnel 61) can be opened in the upper half 33 of the air box 30.

In addition, the air filter 44 is provided between the first and second air suction ports 36*a*, 37*a* and the inlet 61*a* of the funnel 61, whereby the interior of the air box 30 can be partitioned by the air filter 44 into upper end lower portions. With the air filter 44 provided between the first and second air suction ports 36*a*, 37*a* and the inlet 61*a* of the funnel 61, air sucked in through the first and second air suction ports 36*a* and 37*a* can be led to the inlet 61*a* of the funnel 61 through the air filter 44.

At the time of assembling the air passage 60 into the air box 30, the bellows portion 67 of the air passage 60 is disposed by utilizing the space between the first air suction tube 36 and the second air suction tube 37. Accordingly, the condition of the unit in which the air passage 60 is assembled into the air box 30 can be made compact.

Next, the action of the air box 30 provided in the personal watercraft 10 will be described with reference to FIGS. 4 to 6.

Figure 4:
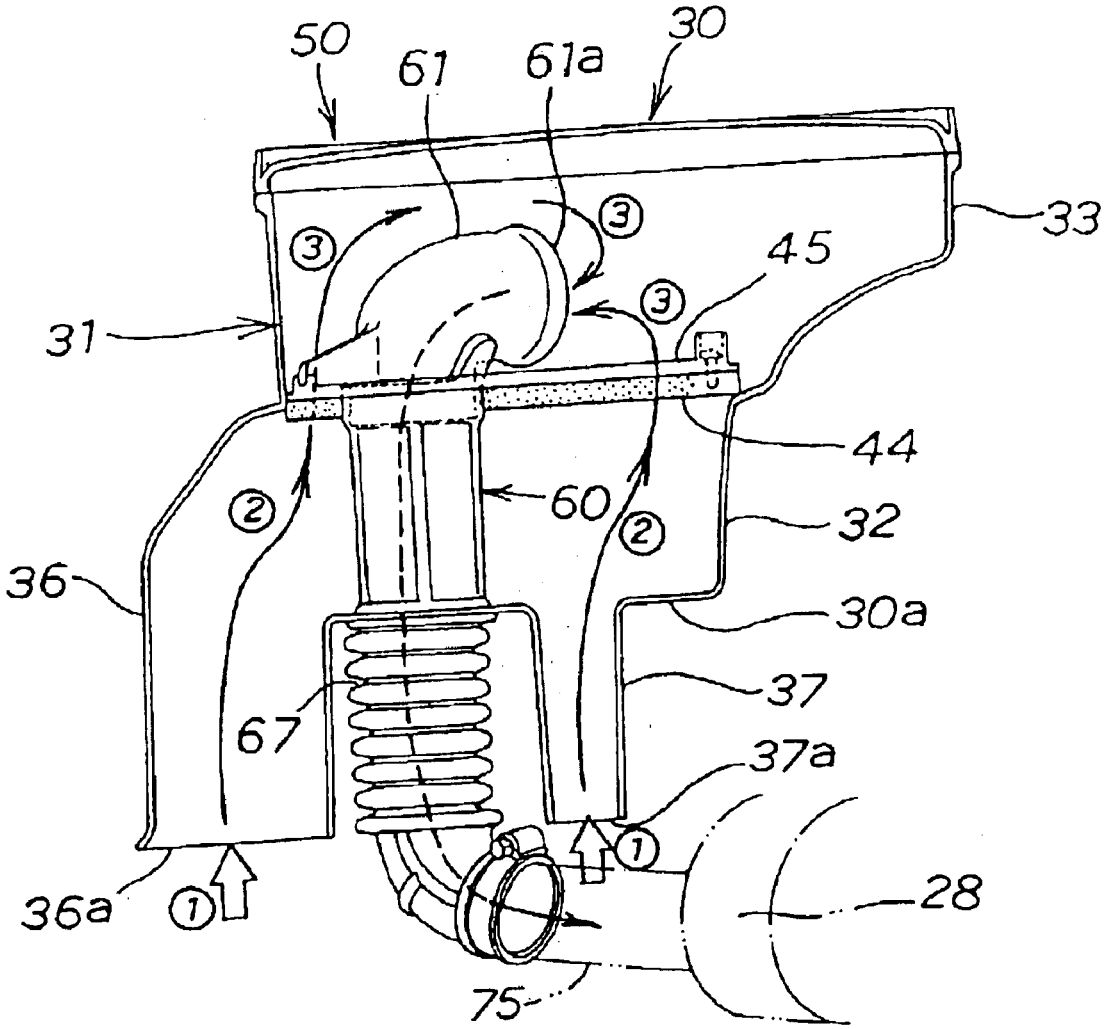
FIG. 4 is a first action illustration showing an action of the personal watercraft according to the present invention.

FIG. 4 is a first action illustration showing an action of the personal watercraft according to the present invention, and shows the condition of sucking in air. The first and second suction tubes 36 and 37 are provided at the lower portion of the air box 30. Air is sucked in through the respective suction ports (first and second suction ports) 36*a* and 37*a* of the first and second suction tubes 36 and 37 as indicated by arrow ①.

The air thus sucked in is led through the first and second suction tubes 36 and 37 to the air filter 44 as indicated by arrow ②, is then made to pass through the air filter 44 as indicated by arrow ③, and is led through the inlet 61*a* of the funnel 61 into the air passage 60. The air led into the air passage 60 is led through the pipe 75 and the turbocharger 28 into the cylinder or cylinders of the engine 18 (shown in FIG. 1). The air sucked in through the first and second suction ports 36*a* and 37*a* is passed through the air filter 44 to thereby remove dust and the like from the air, whereby clean air can be supplied to the engine 18.

Figure 5:
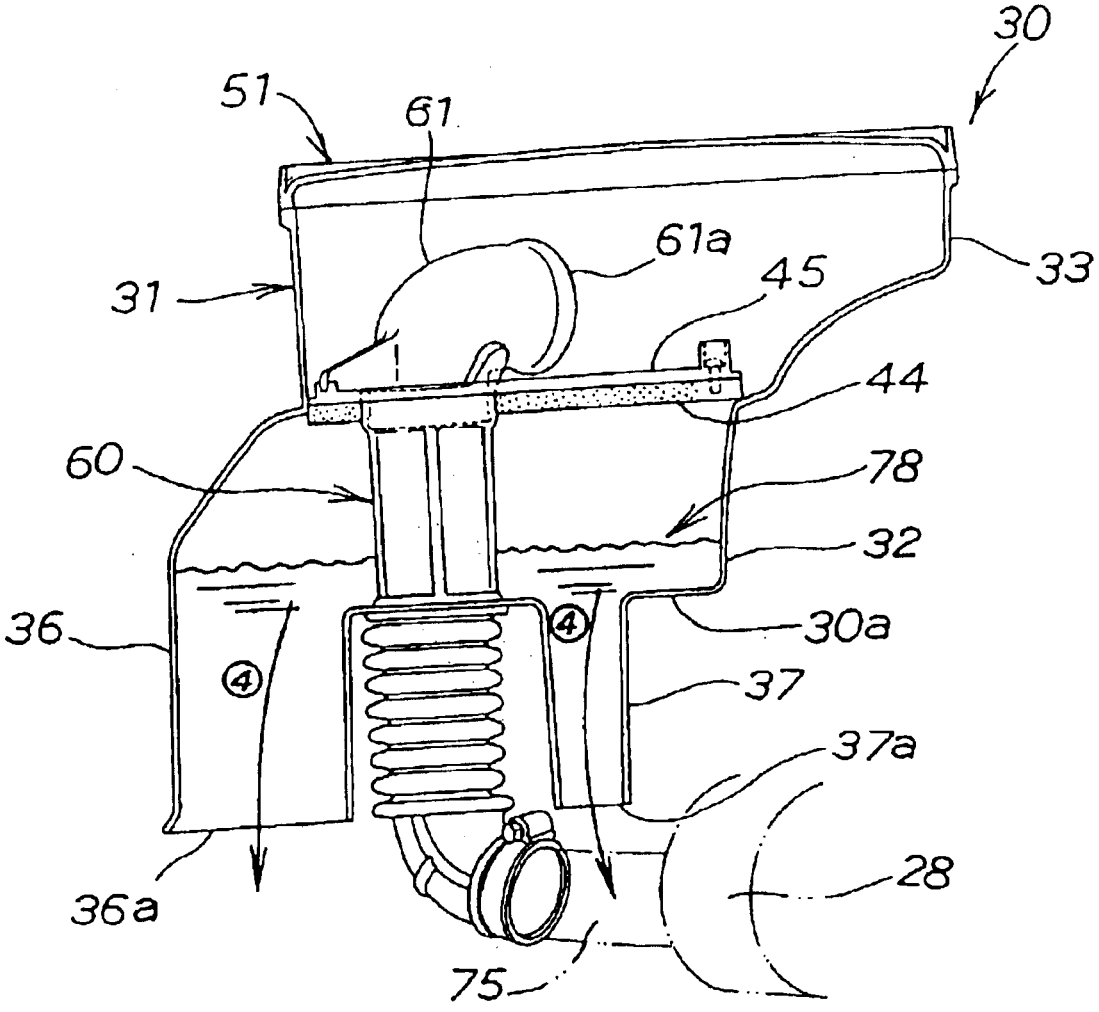
FIG. 5 is a second action illustration showing an action of the personal watercraft according to the present invention.

FIG. 5 is a second action illustration showing an action of the personal watercraft according to the present invention, and shows the condition of draining sea water or water present in the air box. The first and second air suction ports (air suction ports) 36*a* and 37*a* for sucking in air are provided at the lower portion 30*a* of the air box 30. The inlet of the air passage 60 for leading air from the air box 30 to the engine 18 (shown in FIG. 1) (namely, the inlet 61*a* of the funnel 61) can be opened in the upper half 33 of the air box 30.

Therefore, even if the personal watercraft 10 (shown in FIG. 1) is turned upside down and sea water or water 78 penetrates into the air box 30, by restoring the personal watercraft 10 to the normal position, it is possible to cause the sea water or water 78 in the air box 30 to flow into the first and second suction tubes 36 and 37 as indicated by arrow ④ and to drain the sea water or water 78 through the first and second air suction ports 36*a* and 37*a*.

Particularly, with the second air suction tube 37 provided at a substantially central portion of the floor portion 35 of the air box 30, the sea water or water can be securely drained through the second air suction tube 37 and the second air suction port 37*a* so that the sea water or water will not remain on the floor portion 35 of the air box 30. On the other hand, the inlet 61*a* of the funnel 61 for leading air to the engine 18 (shown in FIG. 1) is opened in the upper half 33 of the air box 30, whereby the inlet 61*a* of the funnel 61 can be disposed at a high position.

Accordingly, even if sea water or water 78 penetrates into the watercraft body 11 (shown in FIG. 1), the sea water or water 78 can be restrained from rising up to the inlet 61*a* of the funnel 61, whereby the sea water or water 78 can be prevented from penetrating into the air passage 60 through the inlet 61*a* of the funnel 61.

Figure 6:
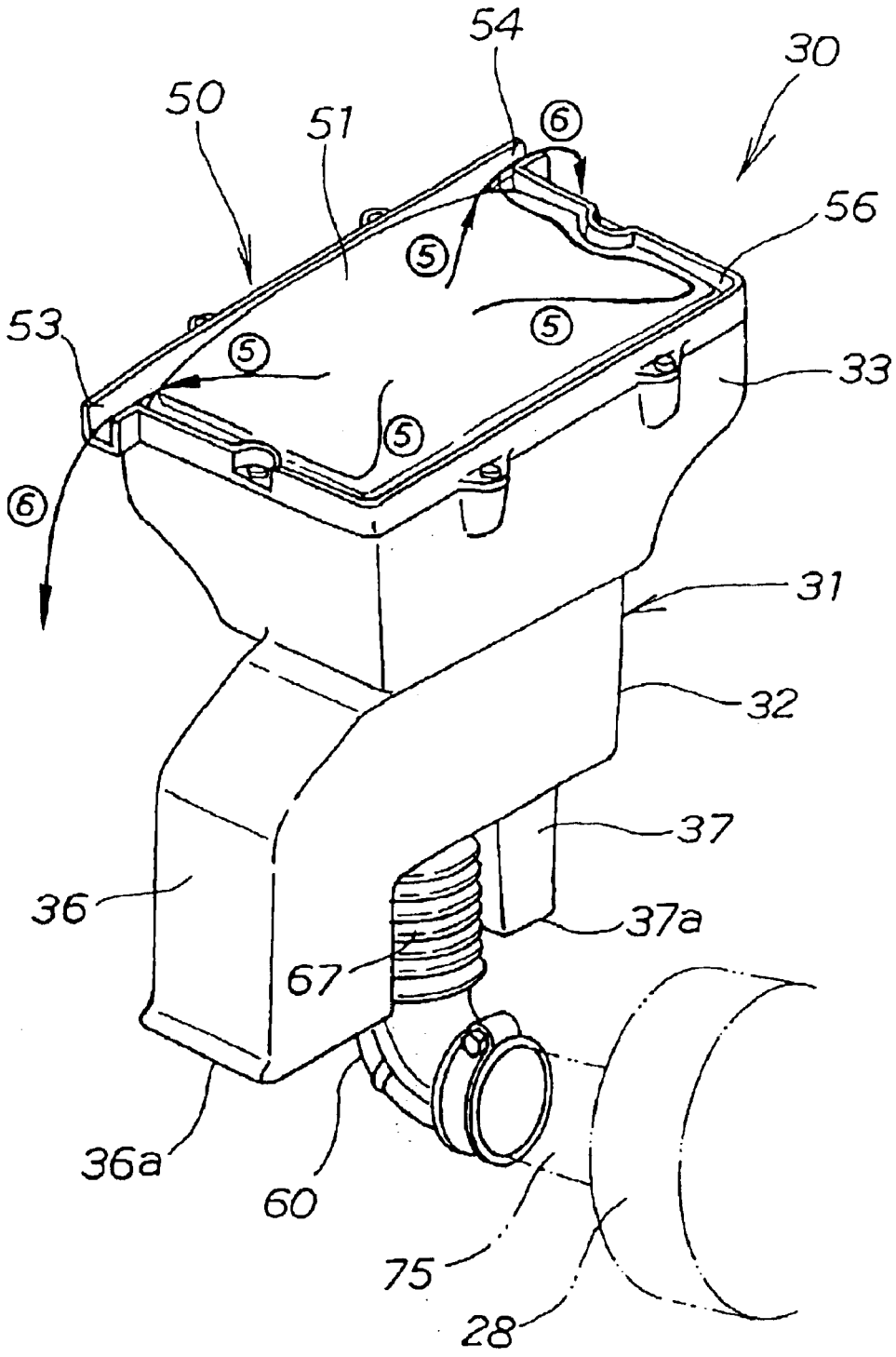
FIG. 6 is a third action illustration showing an action of the personal watercraft according to the present invention.
Figure 7:
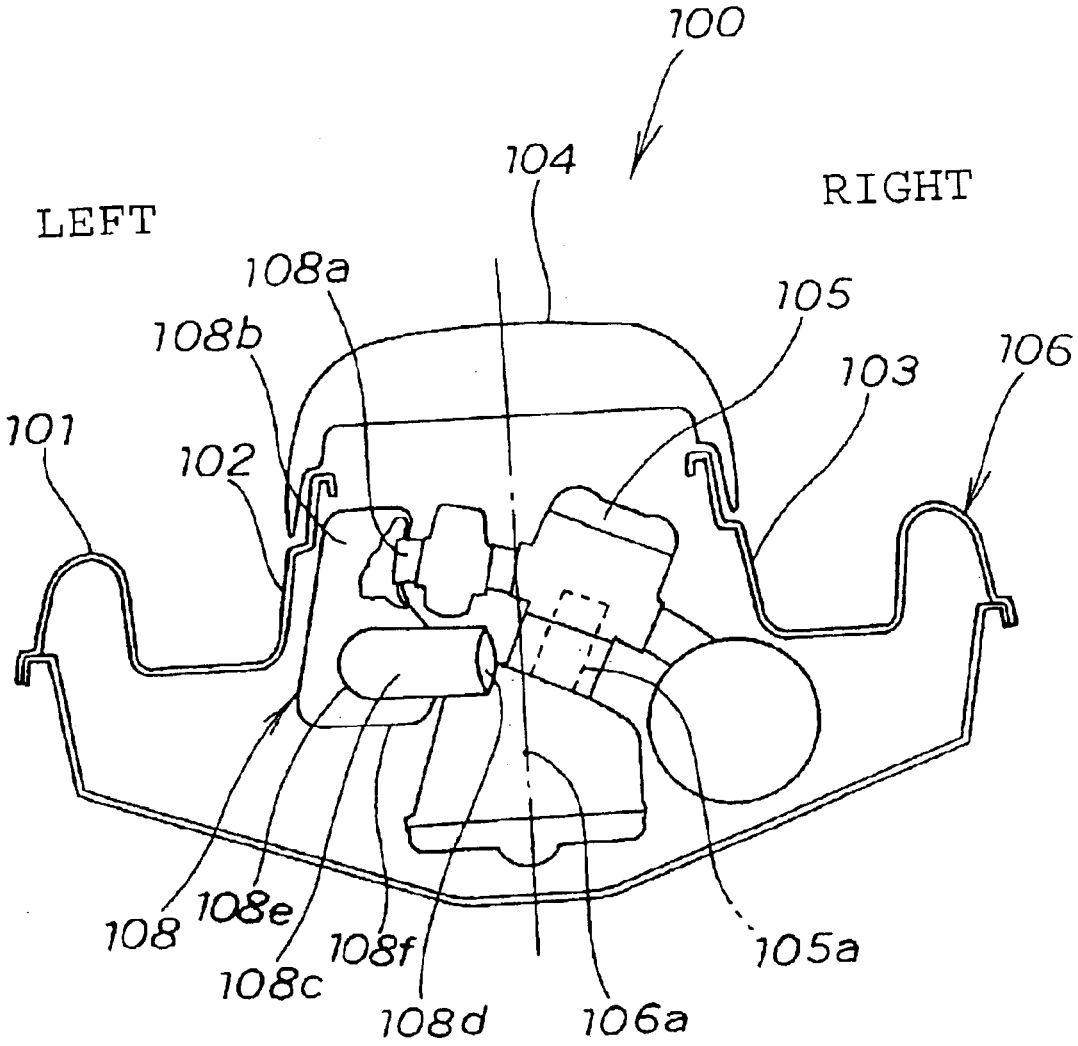
FIG. 7 is a sectional view of a personal watercraft according to the background art.

FIG. 6 is a third action illustration showing an action of the personal watercraft according to the present invention, and shows the condition where sea water or water having splashed onto the top plate of the cover body is drained through the trough portions. The recessed portion 56 is formed by the outer periphery of the top plate 51 of the cover body 50 constituting the air box 30 and the cut-off wall 52. The recessed portion 56 is in communication with the first and second trough portions 53 and 54.

Accordingly, the sea water or water splashed onto the top plate 51 can be led to the recessed portion 56 as indicated by arrows ⑤, the sea water or water led to the recessed portion 56 is led to the first and second trough portions 53 and 54, and it can be drained through the first and second trough portions 53 and 54 as indicated by arrows In this case, the first and second trough portions 53 and 54 are provided in the cut-off wall 52 at portions away from the suction port 36*a* of the first air suction tube 36 and the suction port 37*a* of the second air suction tube 37. Therefore, the sea water or water drained through the first and second trough portions 53 and 54 can be prevented from splashing onto the suction port 36*a* of the first air suction tube 36 and the suction port 37*a* of the second air suction tube 37.

While an example in which the air box 30 is a substantially rectangular vertically elongated box has been described in the above embodiment, this is not limitative, and the shape of the air box 30 can be arbitrarily determined according to the shape of the personal watercraft.

In addition, while a jet propulsion watercraft propelled by a jet propeller as an example of the personal watercraft 10 has been described in the above embodiment, the propulsion means of the personal watercraft is not limited to this.

The present invention constituted as above displays the following effects.

The first aspect of the present invention resides in that the intake system of the engine is provided with the air box, and an air suction port for sucking in air is provided at a lower portion of the air box. Accordingly, even if the personal watercraft is turned upside down and sea water or water penetrates into the air box, the sea water or water in the air box can be drained through the air suction port by restoring the personal watercraft to the normal posture. Therefore, it is possible to prevent the sea water or water from being accumulated in the air box.

In addition, with the inlet of the air passage for leading air to the engine opened in the upper half of the air box, the inlet of the air passage can be disposed at a high position. Accordingly, even if sea water or water penetrates into the watercraft body, the sea water or water can be restrained from rising up to the inlet of the air passage, and the sea water or water can be prevented from penetrating into the engine.

The second aspect of the present invention resides in that the air filter is provided between the air suction port and the inlet of the air passage, whereby air sucked in through the air suction port can be led to the inlet of the air passage through the air filter. Accordingly, dust and the like contained in the air can be removed by the air filter, so that clean air can be led to the inlet of the air passage. Therefore, the engine can be driven favorably.

The third aspect of the present invention resides in that the cut-off wall is arranged along and surrounding the outer periphery of the top plate constituting the air box, whereby the recessed portion can be formed by the outer periphery of the top plate and the cut-off wall. Therefore, sea water or water splashed onto the top plate can be led to the recessed portion.

Furthermore, the cut-off wall is provided with the cutout portion for draining at a portion away from the air suction port, whereby the cutout portion can be in communication with the recessed portion. Accordingly, the sea water or water led to the recessed portion can be drained through the cutout portion.

In addition, the cutout portion is provided at a portion away from the air suction port. Accordingly, the sea water or water drained through the cutout portion can be prevented from splashing onto the air suction port.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A personal watercraft, comprising:

a watercraft body, said watercraft body including a hull constituting a lower portion of said watercraft body and a deck constituting an upper portion of said watercraft body;

an engine, said engine being mounted in a space surrounded by said hull and deck of said watercraft body; and an intake system of said engine, wherein said intake system is provided with a vertically elongate air box, an air suction port for sucking in air is provided at a lower portion of said air box, and an inlet of an air passage for leading air from said air box to said engine is opened in an upper portion of said air box, wherein an air filter is provided between said air intake port and said inlet of said air passage, and the interior of said air box is partitioned by said air filter into said upper portion and said lower portion, and wherein said air filter is provided with a through hole, and said air passage extends through said through hole.

2. The personal watercraft according to claim 1, wherein a cut-off wall is arranged on and surrounding a top plate of said air box, and said cut-off wall is provided with a cutout portion for draining water at a portion away from said air intake port.

3. The personal watercraft according to claim 1, wherein a rear wall of the lower portion of said air box is provided with a first air suction tube, and a floor portion of the lower portion of said air box is provided with a second air suction tube.

4. The personal watercraft according to claim 3, wherein an air filter is provided between said air intake port and said inlet of said air passage, and the interior of said air box is partitioned by said air filter into said upper portion and said lower portion.

5. The personal watercraft according to claim 3, wherein a cut-off wall is arranged on and surrounding a top plate of said air box, and said cut-off wall is provided with a cutout portion for draining water at a portion away from said air intake port.

6. The personal watercraft according to claim 3, wherein a side wall of the upper portion of said air box is provided with a breather pipe, and a breather hose extending from a cylinder head cover of the engine is connected to the breather pipe.

7. The personal watercraft according to claim 1, further comprising a presser member including a frame body formed in a shape conforming to an outer shape of said air filter, said frame body being provided with a through hole aligned with said through hole of said air filter, and said air passage extends through said through hole of said frame body.

8. An intake system for an engine of a personal watercraft, comprising:

a vertically elongate air box, said air box including:

an air suction port, said air suction port being provided at a lower portion of said air box for sucking in air; and an inlet of an air passage for leading air from said air box to the engine, said inlet being opened in an upper portion of said air box, wherein an air filter is provided between said air intake port and said inlet of said air passage, and the interior of said air box is partitioned by said air filter into said upper portion and said lower portion, and wherein said air filter is provided with a through hole, and said air passage extends through said through hole.

9. The intake system according to claim 8, wherein a cut-off wall is arranged on and surrounding a top plate of said air box, and said cut-off wall is provided with a cutout portion for draining water at a portion away from said air intake port.

10. The intake system according to claim 8, wherein a rear wall of the lower portion of said air box is provided with a first air suction tube, and a floor portion of the lower portion of said air box is provided with a second air suction tube.

11. The intake system according to claim 10, wherein an air filter is provided between said air intake port and said inlet of said air passage, and the interior of said air box is partitioned by said air filter into said upper portion and said lower portion.

12. The intake system according to claim 10, wherein a cut-off wall is arranged on and surrounding a top plate of said air box, and said cut-off wall is provided with a cutout portion for draining water at a portion away from said air intake port.

13. The intake system according to claim 10, wherein a side wall of the upper portion of said air box is provided with a breather pipe, and a breather hose extending from a cylinder head cover of the engine is connected to the breather pipe.

14. The intake system according to claim 8, further comprising a presser member including a frame body formed in a shape conforming to an outer shape of said air filter, said frame body being provided with a through hole aligned with said through hole of said air filter, and said air passage extends through said through hole of said frame body.

15. An intake system for an engine of a personal watercraft, comprising:

a vertically elongate air box, said air box including:

an air suction port, said air suction port being provided at a lower portion of said air box for sucking in air; and an inlet of an air passage for leading air from said air box to the engine, said inlet being opened in an upper portion of said air box, wherein a rear wall of the lower portion of said air box is provided with a first air suction tube, and a floor portion of the lower portion of said air box is provided with a second air suction tube.

16. The intake system according to claim 15, wherein an air filter is provided between said air intake port and said inlet of said air passage, and the interior of said air box is partitioned by said air filter into said upper portion and said lower portion.

17. The intake system according to claim 15, wherein a cut-off wall is arranged on and surrounding a top plate of said air box, and said cut-off wall is provided with a cutout portion for draining water at a portion away from said air intake port.

18. The intake system according to claim 15, wherein a side wall of the upper portion of said air box is provided with a breather pipe, and a breather hose extending from a cylinder head cover of the engine is connected to the breather pipe.

19. An intake system for an engine of a personal watercraft, comprising:

a vertically elongate air box, said air box including:

an air suction port, said air suction port being provided at a lower portion of said air box for sucking in air; and an inlet of an air passage for leading air from said air box to the engine, said inlet being opened in an upper portion of said air box, wherein a cut-off wall is arranged on and surrounding a top plate of said air box, and said cut-off wall is provided with a cutout portion for draining water at a portion away from said air intake port.

* * * * *